US006110402A

United States Patent [19]

Miller

[11] Patent Number: 6,110,402

[45] Date of Patent: Aug. 29, 2000

[54] MAGNETICALLY ATTACHED HOLE FORM

[75] Inventor: Michael R. Miller, Churubusco, Ind.

[73] Assignee: Press Seal Gasket Corporation, Fort Wayne, Ind.

[21] Appl. No.: 09/030,266

[22] Filed: Feb. 25, 1998

[51] Int. Cl.[7] ..... B28B 7/28

[52] U.S. Cl. ..... 264/31; 249/39; 249/63; 249/177; 249/184; 264/32; 264/333; 425/DIG. 33

[58] Field of Search ..... 249/35, 39, 63, 249/142, 175, 177, 184; 264/31, 32, 333; 425/3, DIG. 33

[56] References Cited

U.S. PATENT DOCUMENTS

| | | | |
|---|---|---|---|
| 2,959,820 | 11/1960 | Miller et al. | 425/DIG. 33 |
| 3,195,207 | 7/1965 | Fougea | 425/3 |
| 3,567,174 | 3/1971 | Grace | 425/3 |
| 3,680,826 | 8/1972 | Bassani | 249/177 |
| 3,961,013 | 6/1976 | Gutlhuber et al. | 425/3 |
| 4,159,098 | 6/1979 | Wong | 425/DIG. 33 |
| 4,177,229 | 12/1979 | Moore | 249/177 |
| 4,318,880 | 3/1982 | McIntosh et al. . | |
| 4,625,976 | 12/1986 | Gilbert . | |
| 4,650,149 | 3/1987 | Poulette et al. . | |
| 4,732,397 | 3/1988 | Gavin . | |
| 4,768,748 | 9/1988 | Leimjuhler et al. | 425/3 |
| 5,171,507 | 12/1992 | Del Zotto . | |
| 5,328,294 | 7/1994 | Miller . | |
| 5,381,995 | 1/1995 | Del Zotto . | |
| 5,492,656 | 2/1996 | Tracy . | |
| 5,624,123 | 4/1997 | Meyers . | |
| 5,651,911 | 7/1997 | Pennypacker | 249/177 |

*Primary Examiner*—James P. Mackey
*Attorney, Agent, or Firm*—Barnes & Thornburg

[57] ABSTRACT

An attachment mechanism for a hole form that is used to secure the hole form to a form wall during a casting process. The attachment mechanism includes a hole form having an opening formed in the face thereof and a magnet assembly which is received in the opening of the hole form. The magnet assembly can include a flange portion which can be received in a corresponding stepped portion of the opening. The magnet assembly is removable and can be used in other hole forms.

27 Claims, 5 Drawing Sheets

MAGNETICALLY ATTACHED HOLE FORM

TECHNICAL FIELD

The present invention relates to cast concrete structures. More particularly, the present invention relates to processes and apparatus for casting manholes and related structures with holes or openings therein.

BACKGROUND ART

The formation of holes in poured or cast concrete structures can be achieved by a variety of available molding or forming dies or mandrels. These dies can range from rudimentary structures to complex assemblies.

A typical casting process in which one or more openings or holes are formed in a manhole involves positioning hole forms, e.g. a plug or mandrel, through a wall of the casting mold or between walls of a casting mold. Since the alignment of wall penetrations vary widely from one structure to the next and can require changes in elevation, penetration angle, diameter, etc., the number of hole form shapes is virtually infinite.

Current practice is to place a hole form through a cutout in the reinforcing steel structure and secure it in place using thin wire. This method does not position the hole form with sufficient accuracy, and the wire ends tend to scrape the hole form during casting and vibration, creating surface blemishes in the hole form which reduces its life and effectiveness.

An alternative method of mounting hole forms involves the use of vacuum generating devices that are permanently attached to hole forms. Such vacuum generating devices consist of multiple components which are easily degraded by dust and abrasion, limiting the durability and effectiveness of these devices. Also, being an attachment device, the expense of the vacuum holder must be included into the cost of each hole form, making the overall expense of the assembly unreasonably high.

The present invention provides a means and method for securing hole forms in place during casting operations.

DISCLOSURE OF THE INVENTION

According to further features and characteristics of the present invention which will become apparent as the description thereof proceeds below, the present invention provides a hole form assembly for forming openings in cast structures which includes:

at least one hole form, having a face from which a peripheral side wall extends and an opening formed in the face; and at least one magnet assembly having a magnetic face and being shaped and sized to be received in the opening of the hole form so that the magnetic face of the magnet assembly is substantially flush with the face of the hole form when the magnet assembly is received in the opening of the hole form.

The present invention further provides a method of forming openings in cast structure which involves:

providing a cast form that includes a metal form wall;

providing a hole form having a face from which a peripheral side wall extends and an opening formed in the face;

providing a magnet assembly having a magnetic face and being shaped and sized to be received in the opening of the hole form so that the magnetic face of the magnet assembly is substantially flush with the face of the hole form when the magnet assembly is received in the opening of the hole form;

positioning the magnet assembly in the opening in the hole form and attaching the hole form to the metal form wall by the magnet; and casting a structure with the cast form.

The present invention also provides a hole form assembly for forming openings in cast structures which includes:

at least one hole form having a back, a face from which a peripheral side wall extends, and a first opening formed in the face;

at least one magnet assembly support coupled to the back of the at least one hole form and including a second opening formed therein; and at least one magnet assembly having a magnetic face and being shaped and sized to be received in the second opening so that the magnetic face of the magnet assembly is substantially flush with the back of the hole form when the magnet assembly is received in the second opening.

BRIEF DESCRIPTION OF DRAWINGS

The present invention will be described hereafter with reference to the attached drawings which are given as non-limiting examples only, in which.

BEST MODE FOR CARRYING OUT THE INVENTION

The present invention is directed to magnetically attachable hole forms which can be used in processes for casting manholes and related structures with holes or openings therein. The present invention provides a magnet or magnets which can be used in combination with a series or set of hole forms of different sizes and shapes The magnet or magnets are removably attachable to the hole forms so that they can be interchanged and used with a plurality of hole forms. The hole forms can be made out of ferrous or non-ferrous metal, fiberglass, or other suitable sturdy materials. Lighter materials that are sturdy such as fiberglass are easier to handle. However, hole forms made from lighter materials are proportionally more buoyant and tend to float when surrounded or submerged in wet concrete. It accordingly takes stronger magnetic forces to maintain the position and alignment of lighter, more buoyant hole forms.

The face of the magnets should have a profile which is substantially complementary to the profile of the wall form to which the magnets (and hole forms) are to be attached. In the case of a hole form and magnet that are used to cast a manhole with an opening therein, the face of the hole form should have a curved profile to match the curved wall form that defines the inner surface of the cast manhole, and the face(s) of the magnet(s) can have a flat profile with small diameter. Otherwise, the magnet(s) can have a narrow width and a length which extends along the axial direction of the curved wall form. The hole forms can be designed to receive one magnet or a plurality of magnets.

The magnets are preferably provided with a release mechanism which can be operated to break the magnetic force between the magnet(s) and the wall form. The release mechanism can include a threaded bore that extends through the body of the magnet(s) and a threaded member, e.g., bolt that is received in the threaded bore of the magnet body.

According to one embodiment of the present invention the magnets are provided with a stepped or flange portion which is received in a stepped through-bore in the hole forms. In this embodiment, a cushioning member such as an o-ring can be provided near the periphery of the flange portion to protect the hole forms near the edge of the through-openings. According to a further embodiment, the magnets can be embedded or molded into an elastomeric or polymeric structure which has a stepped or flange portion. This embodiment can further include a reinforcing structure at the flange portion, which reinforces the structure, distributes the magnetic force and prevents deformation when used to secure a hole form.

Figure 1:
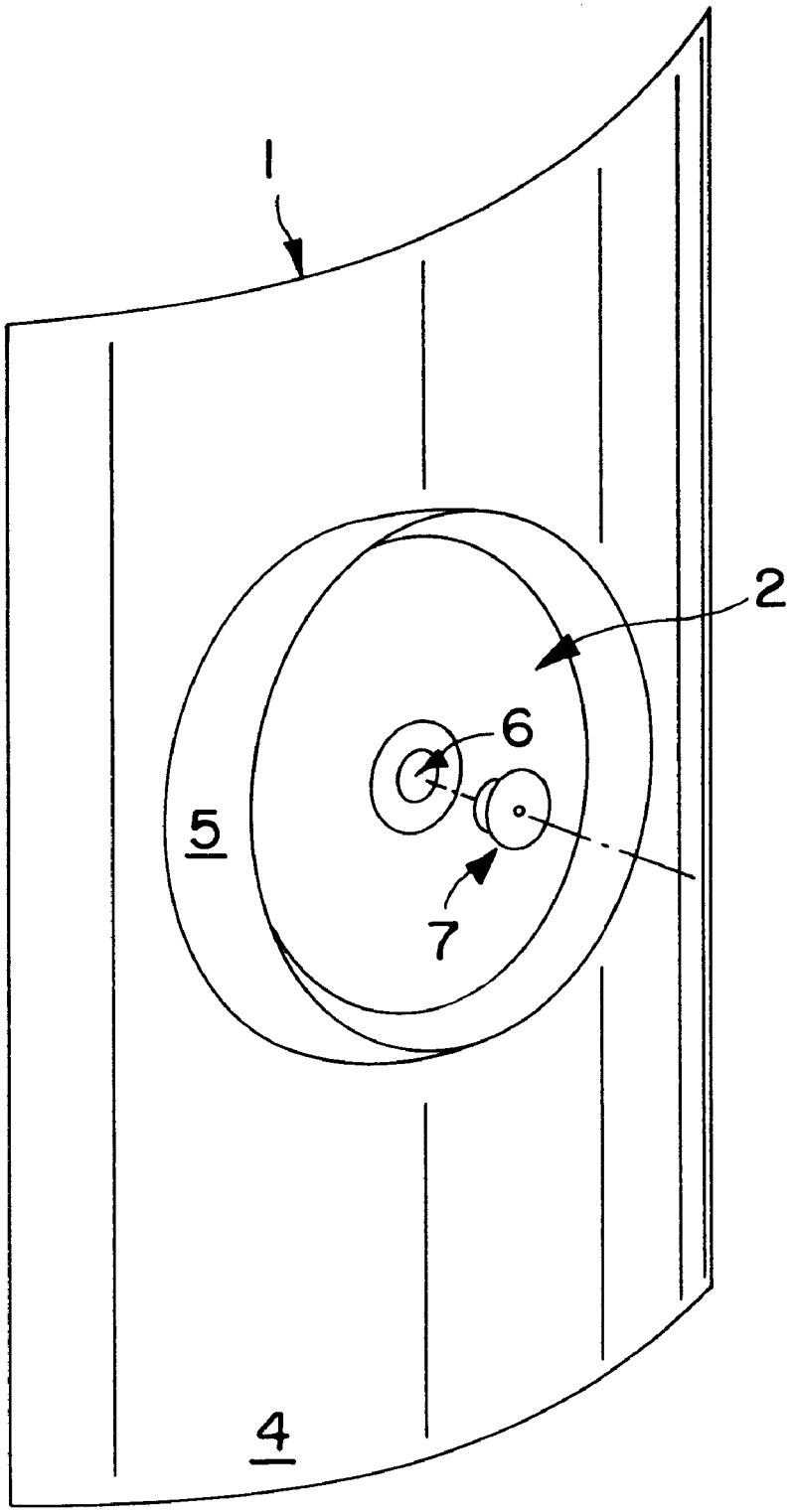
FIG. 1 is an exploded perspective view which depicts a magnetic hole form assembly according to one embodiment of the present invention.

FIG. 1 is an exploded perspective view which depicts the magnetic hole form assembly of the present invention. In FIG. 1 a portion of an inner wall form is identified by reference numeral 1. This inner wall form 1 is cylindrical as shown and can be used to define the inner surface of a manhole. A hole form 2 according to the present invention is provided with a face 3 (FIG. 3) that is contoured to match the outer surface 4 of the inner wall form 1. The hole form 2 is provided with a side wall 5 which is used to define the inner surface of an opening formed in the side of the cast structure, e.g. manhole. The hole form 2 is further provided with a stepped through-bore 6 which is designed to receive a magnet assembly 7 therein. As described below, the magnet assembly 7 includes a flange portion 8 (FIG. 4) which is received in the stepped through-bore 6 of the magnet assembly 7. These structures are dimensioned so that the face 3 of the hole form 2 and the face 9 (FIG. 4) of the magnet assembly are substantially flush.

The hole form 2 depicted in FIG. 1 has a cylindrical shape and will accordingly form circular openings in the cast structure, e.g manhole. The side wall 5 of the hole form 2 will define the angle at which an opening is formed in the cast structure. Accordingly, the side wall 5 can be aligned with the face 3 of the hole form 2 so as to form an opening that is perpendicular to the axis of the inner wall form 1. Otherwise, the side wall 5 can be aligned with the face 3 of the hole form 2 so as to form an opening that is aligned with the axis of the inner wall form 1 at any desired angle.

The hole form 2 in FIG. 1 is depicted as having a single through-bore 6 that is centrally located. As discussed below, the hole form 2 can be provided with more than one through-bore 6 for receiving an equal number, i.e. a plurality of magnet assemblies 7. As further discussed below, the shape of the through-bores 6 and magnet assemblies 7 can be other than circular.

It is to be understood that the side wall 5 of the hole form 2 depicted in FIG. 1 is equal to the thickness of the cast structure, e.g. manhole, and that the complete casting form includes an outer wall form which is not depicted in FIG. 1.

Figure 2:
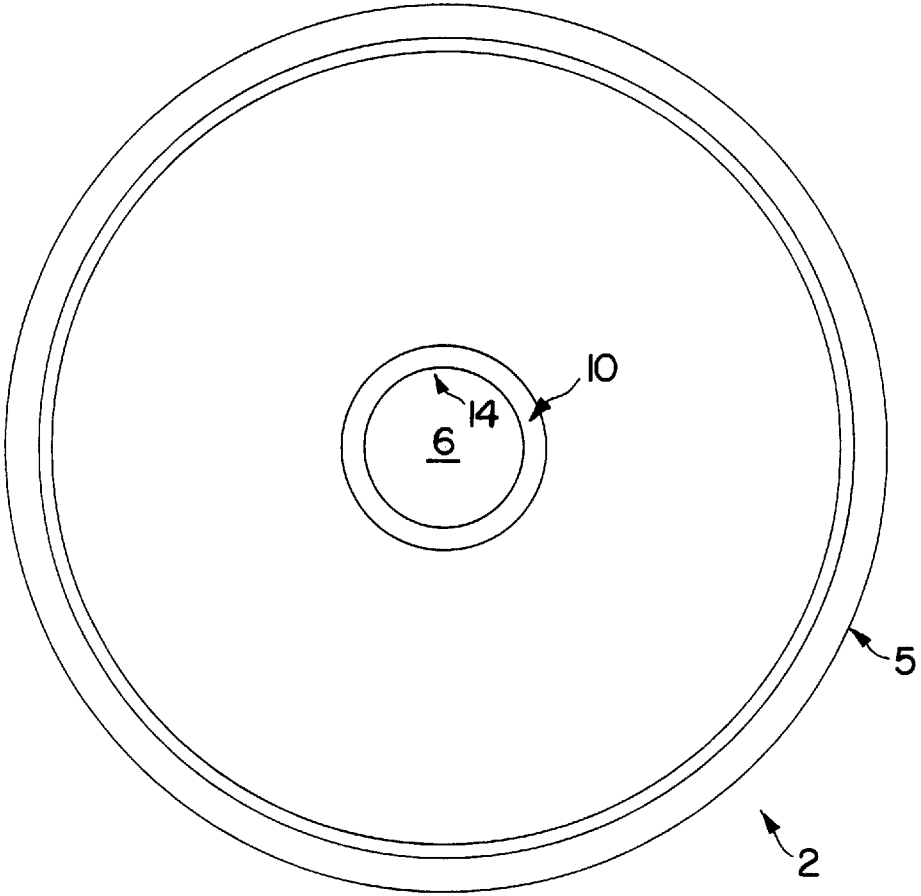
FIG. 2 is an end view of a hole form according to one embodiment of the present invention.

FIG. 2 is an end view of a hole form according to one embodiment of the present invention. The hole form 2 in FIG. 2 has a circular shape and a side wall 5 which is substantially perpendicular to the face 3 (FIG. 3) thereof. Through-bore 6 is depicted as being centrally located in the face 3 of the hole form 2. It is to be understood that the through-bore 6 can be located in positions other than the center of the face 3 of the hole form 2. The stepped portion 10 of the through-bore 6 can be seen in FIG. 2.

Figure 3:
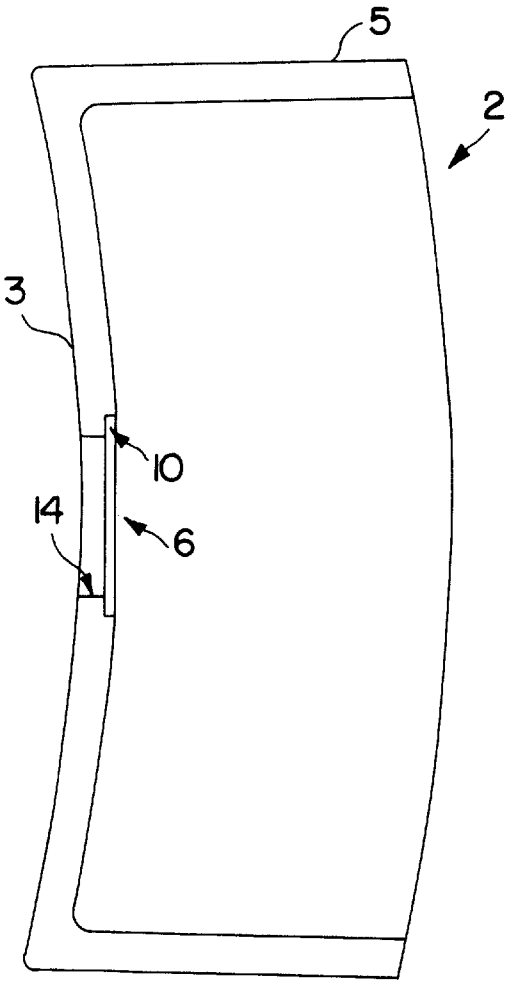
FIG. 3 is a cross-sectional side view of the hole form of FIG. 2.

FIG. 3 is a cross-sectional side view of the hole form of FIG. 2. The face 3 of the hole form 2 is contoured or curved to match the outer curved surface 4 of the inner wall form 1 depicted in FIG. 1. The stepped portion 10 of through-bore 6 is shown in cross-section in FIG. 3.

As discussed above, the hole forms of the present invention can be made of ferrous or non-ferrous metals, fiberglass, or other suitable sturdy materials, or materials which are reinforced or composite materials. Although the hole forms 2 of FIGS. 1–3 are depicted as having faces 3 that are curved and designed to fit against the cylindrical surface of the inner wall form 1 depicted in FIG. 1, it is to be understood that the faces 3 of the hole forms 2 can have other contoured shapes or be flat, as necessary for use in casting various structures. As further discussed above, the side wall(s) 5 of the hole forms 2 can be perpendicular to the wall form 1 to which they are attached during a casting process, or be other than perpendicular to the wall form 1 to which they are attached during a casting process.

Figure 4:
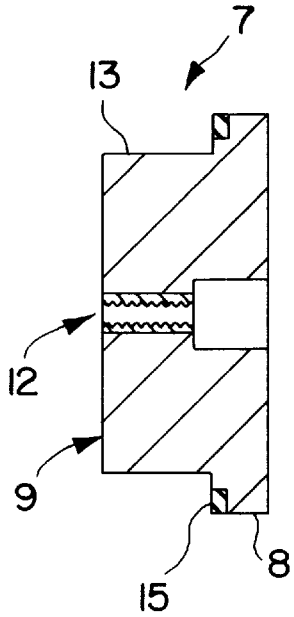
FIG. 4 is a cross-sectional side view of a magnet assembly according to one embodiment of the present invention.

FIG. 4 is a cross-sectional side view of a magnet assembly according to one embodiment of the present invention. The magnet assembly 7 of FIG. 4 includes a body 11 having a stepped or flange portion 8, and a threaded through-bore 12 therein. The flange portion 8 of the magnet assembly 7 is shaped and sized to be received in the stepped portion 10 of the through-bore 6 in the hole forms 2. The narrow portion 13 of the magnet assembly 7 is sized and shaped to be received in the narrower portion 14 of the through-bore 6 so that the face 9 of the magnet assembly 7 is substantially flush with the face 3 of the hole form 2. It is to be understood that the through-bores 6 and magnet assemblies 7 are not limited to having a circular shape as depicted. In this regard, the through-bores 6 and magnet assemblies 7 can be rectangular, square, ovular, polygonal, or have any desired shape.

In FIG. 4, a cushioning element, e.g. o-ring 15, can be provided on the flange portion 8 of the magnet assembly 7. This cushioning element can be used to protect the hole forms 2 from being scratched or chipped near the edge of the through-bores 6.

The threaded through-bore 12 is designed to receive a threaded member, e.g., bolt, that can be used to break the magnetic force between the magnet assemblies 7 and the wall forms 1. In operation, a threaded member, e.g. bolt 16 (FIG. 6) is inserted into threaded through-bore 12 and driven therein until the end thereof extends beyond the face 9 of the magnet assembly 7. This causes the face 9 of the magnet assembly 7 to be pushed away from the face 4 of a wall form 1. This operation can be used to remove the magnet assembly 7 or to adjust the position thereon on a wall form 1.

Ideally, the present invention provides a number (e.g. set or series) of hole forms and a magnet assembly which can be inserted and used with any one hole form. Thus, each of the hole forms includes a through-bore which is substantially identical in size and shape so as to be used in conjunction with a common magnet assembly. It is of course possible to utilize magnet assemblies that have different shapes and sizes in conjunction with one or more hole forms that have complementarily sized and shaped through-bores.

Figure 5:
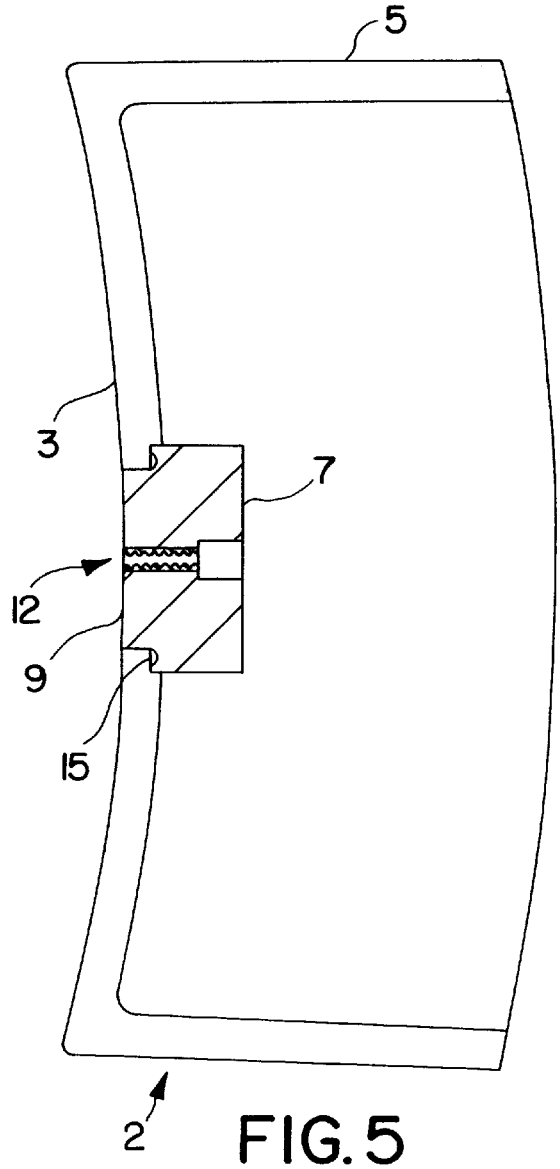
FIG. 5 is a cross-sectional side view of a magnetic hole form assembly which includes the magnet assembly of FIG. 4.

FIG. 5 is a cross-sectional side view of a magnetic hole form assembly which includes the magnet assembly of FIG. 4. FIG. 5 depicts how the magnet assembly 7 is received in the through-bore 6 of a hole form 2. It is noted that the magnet assembly 7 includes a substantially flat face 9. The shape of this flat face 9 is contrasted somewhat with the curved face 3 of the hole form 2. Although it is possible to form contoured, e.g. curved faces on the magnet assemblies 7, it has been discovered that it is not necessary for the faces of the magnet assemblies 7 to have the exact same couture as the face of the hole forms 2 (or wall form). In this regard, all that is necessary is that a sufficient portion of the magnet assembly 7 contact a wall form to create a magnetic force that supports the weight of the hole form 2 (an resists buoyancy during casting). During the course of the present invention, it was determined that magnet assemblies having a flat surface face area of approximately four square inches and capable of producing 330 lbs. of force were more than sufficient to support fiberglass hole forms having standard diameters for manhole openings.

Figure 6:
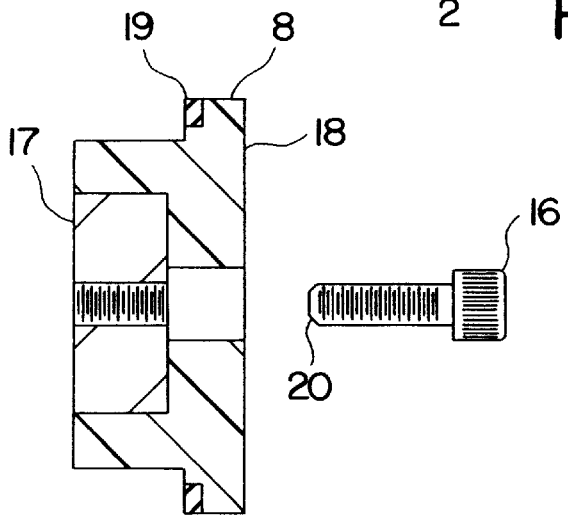
FIG. 6 is a cross-sectional side view of a magnet assembly according to another embodiment of the present invention.

FIG. 6 is a cross-sectional side view of a magnet assembly according to another embodiment of the present invention. The magnet assembly 7 depicted in FIG. 6 includes a magnet body 12 which is embedded or molded into an elastomeric or polymeric structure 18 which has a stepped or flange portion 8. The elastomeric or polymeric structure 18 protects the hole form 2 from scratching, chipping, etc. The flange portion 8 can be provided with a reinforcing structure, e.g, ring 19 which reinforces the structure, distributes force and prevents deformation. Such a reinforcing structure 19 may be desired when using an elastomeric material such as rubber.

The magnet body 19 includes a threaded through-bore 12 which is similar to the threaded through-bore 12 in FIG. 4. FIG. 6 further depicts a threaded member 16 which can be used as means for releasing the magnet assembly 7. That is, as discussed above, threaded member 16 can inserted into threaded through-bore 12 and driven therein until the end thereof 20 extends beyond the face 9 of the magnet assembly 7. This causes the face 9 of the magnet assembly 7 to be pushed away from the face 4 of a wall form 1. The operation can be used to remove the magnet assembly 7 (and hole form 2) or to adjust the position thereof on a wall form.

Although the magnet body 17 is depicted as having a cylindrical shape, it is possible to vary the shape thereof. For example, the magnet body 17 could have a stepped, grooved, flange portion, etc., by which it can be more securely held in the elastomeric or polymeric portion 18.

Figure 7A:
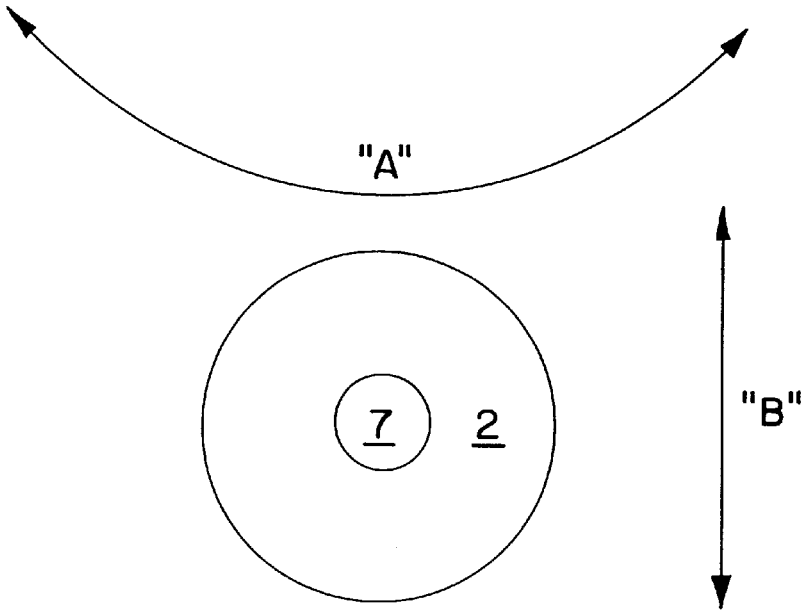
FIGS. 7A and 7B are diagrams which depict the use of alternative magnet assembly shapes.
Figure 7B:
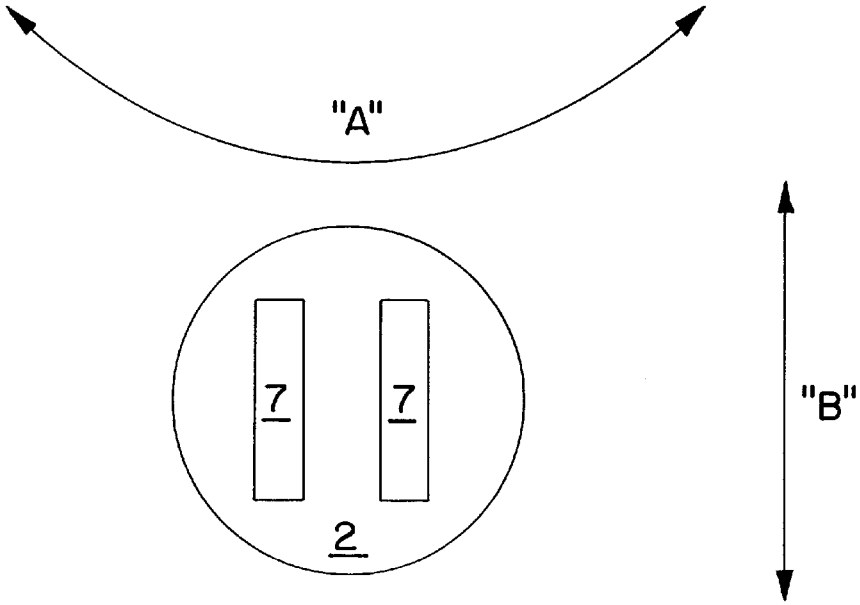

FIGS. 7*a* and 7*b* are diagrams which depicts the use of alternative magnet shapes. In FIGS. 7*a* and 7*b*, double-headed curved arrows "A" represent the contour of a cylindrical wall form along the horizontal direction, similar to that depicted in FIG. 1. It is to be understood that the contour of this wall form is flat in the vertical direction. In order to be contoured to fit against the wall form, the hole forms 2 depicted in FIGS. 7*a* and 7*b* have to be curved in the direction of arrows "A" and flat in the direction of arrows "B." In the case of magnet assemblies having flat faces, there will be less surface contact between these magnets and the wall form as the size of the magnets increase in the direction of arrows "A". However, since the cylindrical wall form is flat in the vertical direction, the size of the magnet assemblies 7 can be increased in the direction of arrow "A" without reducing the surface area contact between the faces of the magnet assemblies 7 and the wall form. Thus, rectangular shaped magnet assemblies 7 as depicted in FIG. 7*b* can be used. Similar shape-adjusted magnet assemblies can be used for wall forms having different contoured shapes.

According to other embodiments of the hole form assembly of the present invention, the magnet assembly can be used to secure the hole form to an outer form wall or form jacket. This requires that the magnet assembly be aligned with the back edge of the hole form.

Figure 8:
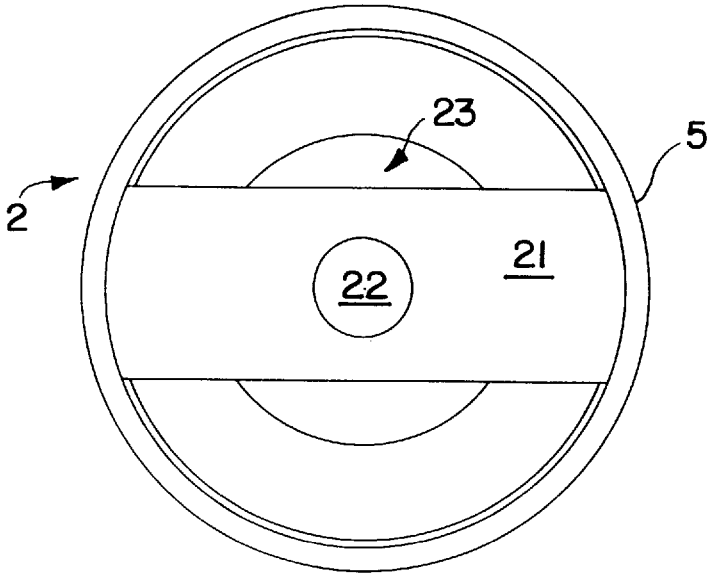
FIG. 8 is an end view of a hole form according to another embodiment of the present invention.

FIG. 8 is an end view of a hole form according to another embodiment of the present invention. The hole form 2 includes a magnet assembly support member 21 that is substantially flush with the back edge of the hole form 2, and which extends between side wall 5 at opposite ends. The magnet assembly support member 21 includes a stepped through-bore 22 which is substantially similar to the stepped through-bore 6 depicted in FIGS. 1–3 and 5. Stepped through-bore 22 is provided to receive a magnet assembly 7 similar to that depicted in FIGS. 4 or 6. The magnet assembly support member 21 can be permanently attached to the side wall 5 of the hole form 2, or coupled thereto using any convenient means, i.e. screws, bolts, quick release interlocking structures, etc.

An opening 23 is provided in the face 3 of the hole form 2. Opening 23 provides access to the through-bore 22 for inserting a magnet assembly therein and for removing a magnet assembly therefrom. Opening 23 can be large enough to remove the magnet assembly support member 21 therethrough if desired.

Figure 9:
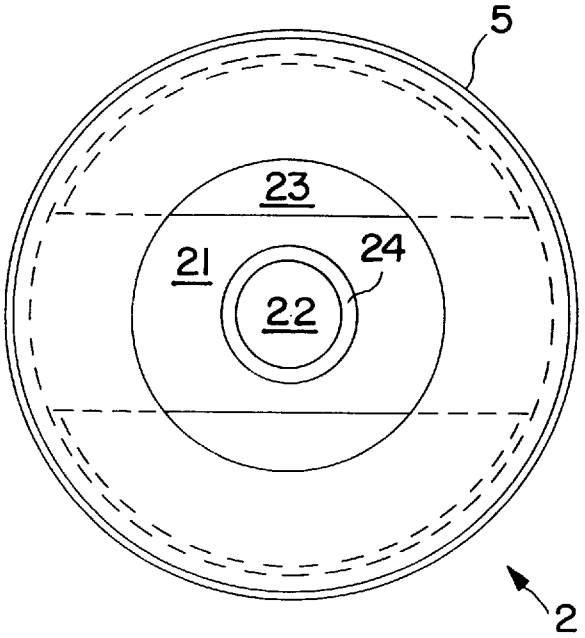
FIG. 9 is a front view of the hole form of FIG. 8.

FIG. 9 is a front view of the hole form of FIG. 8. FIG. 9 depicts the stepped portion 24 of stepped through-bore 22.

Figure 10:
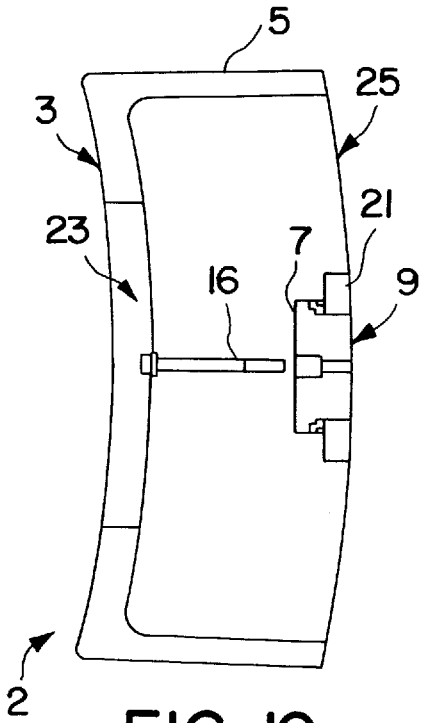
FIG. 10 is a cross-sectional view of the hole form of FIG. 8.

FIG. 10 is a cross-sectional view of the hole form of FIG. 8 with a magnet assembly positioned in the stepped through-bore. The manner in which the magnet assembly 7 is received in the stepped-through bore 22 is similar to that depicted in FIG. 5. That is, the flange portion 8 of the magnet assembly 7 is received in the stepped portion 24 of the stepped through-bore 22, so that the face 9 of the magnet assembly 7 is substantially flush with the back 25 of the hole form 2. FIG. 10 further depicts a threaded member 16 which can be used to break the magnetic force between the magnet assembly 7 and a wall form. It is to be understood that the magnet assembly support member 21 of FIGS. 8–10 could be provided with more that one stepped through-bore and with stepped through bores that are other shapes than circular. It is also to be understood that the magnet assembly support member 21 could have other shapes than the rectangular shape that is illustrated. For example, the magnet assembly support member could have a "Y" shape, and "X" shape or any other desired shape, or it could extend across the entire back of the hole form 2.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed:

1. A hole form assembly for forming openings in cast structures which comprises:

at least one hole form having a face from which a peripheral side wall extends and a through-hole formed in the face; and at least one magnet assembly having a magnetic face and being shaped and sized to be received in the through-hole of the hole form so that the magnetic face of the magnet assembly is substantially flush with the face of the hole form when the magnet assembly is received in the through-hole of the hole form.

2. A hole form assembly for forming openings in cast structures according to claim 1, wherein the magnet assembly has a flange structure and the through-hole of the hole form includes a stepped portion which receives the flange structure of the magnet assembly.

3. A hole form assembly for forming openings in cast structures according to claim 1, wherein the magnet assembly includes a threaded through-bore into which a threaded member can be driven so that an end of the threaded member extends beyond the face of the magnetic face.

4. A hole form assembly for forming openings in cast structures according to claim 1 wherein the magnet assembly includes a cushioning element that protects the hole form.

5. A hole form assembly for forming openings in cast structures according to claim 1, wherein the magnet assembly includes a portion of resilient material that includes a flange and a magnet portion that is positioned in the portion of resilient material.

6. A hole form assembly for forming openings in cast structures according to claim 1, wherein the through-hole of the hole form and the magnet assembly have a circular shape.

7. A hole form assembly for forming openings in cast structures according to claim 1, wherein the through-hole of the hole form and the magnet assembly have an elongate shape.

8. A hole form assembly for forming openings in cast structures according to claim 1, wherein the at least one hole form comprises a plurality of hole forms, and the at least one magnet assembly comprises a magnet assembly that can be received in the through-holes of each of the plurality of hole forms.

9. A hole form assembly for forming openings in cast structures according to claim 1, wherein the at least one hole form includes a plurality of through-holes formed in the face thereof and the at least one magnet assembly includes a number of magnet assemblies which is equal to the number of through-holes formed in the face of the hole form.

10. A method of forming openings in cast structure which comprises:

providing a cast form that includes a metal form wall;

providing a hole form having a face from which a peripheral side wall extends and through-hole formed in the face;

providing a magnet assembly having a magnetic face and being shaped and sized to be received in the through-hole of the hole form so that the magnetic face of the magnet assembly is substantially flush with the face of the hole form when the magnet assembly is received in the through-hole of the hole form;

positioning the magnet assembly in the through-hole in the hole form and attaching the hole form to the metal form wall by the magnet; and casting a structure with the cast form.

11. A method of forming openings in cast structures according to claim 10, further comprising:

providing the magnet assembly with a flange structure;

providing the through-hole of the hole form with a stepped portion;

and positioning the magnet assembly in the through-hole so that the flange thereof is received in the stepped portion of the through-hole.

12. A method of forming openings in cast structures according to claim 10, further comprising:

providing the magnet assembly with a threaded through-bore; and inserting and driving a threaded member into the threaded through-bore to release the magnet assembly from the metal wall form.

13. A method of forming openings in cast structures according to claim 10, further comprising:

providing a cushioning element between the magnet assembly and the hole form.

14. A method of forming openings in cast structures according to claim 10, further comprising:

providing the magnet assembly with a portion of resilient material that includes a flange and a magnet portion that is positioned in the portion of resilient material.

15. A method of forming openings in cast structures according to claim 10, further comprising:

providing the through-hole in the hole form with a circular shape.

16. A method of forming openings in cast structures according to claim 11, further comprising:

providing the through-hole in the hole form with a non-circular shape.

17. A method of forming openings in cast structures according to claim 10, further comprising:

providing the hole form with a plurality of through-holes in the face thereof; and providing a magnet assembly in each of the plurality of through-holes.

18. A method of forming openings in cast structures according to claim 10, wherein the cast structure is a concrete manhole.

19. A hole form assembly for forming openings in cast structures which comprises:

at least one hole form having a back, a face from which a peripheral side wall extends, and a first through-hole formed in the face;

at least one magnet assembly support coupled at opposite ends thereof to the peripheral side wall adjacent the back of the at least one hole form and including a second through-hole formed therein; and at least one magnet assembly having a magnetic face and being shaped and sized to be received in the second through-hole so that the magnetic face of the magnet assembly is substantially flush with the back of the hole form when the magnet assembly is received in the second through-hole.

20. A hole form assembly for forming openings in cast structures according to claim 19, wherein the magnet assembly has a flange structure and the second through-hole includes a stepped portion which receives the flange structure of the magnet assembly.

21. A hole form assembly for forming openings in cast structures according to claim 19, wherein the magnet assembly includes a threaded through-bore into which a threaded member can be driven so that an end of the threaded member extends beyond the face of the magnetic face.

22. A hole form assembly for forming openings in cast structures according to claim 19, wherein the magnet assembly includes a cushioning element that protects the hole form.

23. A hole form assembly for forming openings in cast structures according to claim 19, wherein the magnet assembly includes a portion of resilient material that includes a flange and a magnet portion that is positioned in the portion of resilient material.

24. A hole form assembly for forming openings in cast structures according to claim 19, wherein the second through-hole and the magnet assembly have a circular shape.

25. A hole form assembly for forming openings in cast structures according to claim 1, wherein the face of the at least one hole form has a curved shape.

26. A method of forming openings in cast structures according to claim 10, wherein the face of the at least one hole form has a curved shape.

27. A hole form assembly for forming openings in cast structures according to claim 19, wherein the face of the at least one hole form has a curved shape.

* * * * *